US010352329B2

(12) United States Patent
Nesteroff et al.

(10) Patent No.: US 10,352,329 B2
(45) Date of Patent: Jul. 16, 2019

(54) IMPELLER SHROUD WITH THERMAL ACTUATOR FOR CLEARANCE CONTROL IN A CENTRIFUGAL COMPRESSOR

(71) Applicant: Rolls-Royce Corporation, Indianapolis, IN (US)

(72) Inventors: Michael Nesteroff, Indianapolis, IN (US); Jonathan Acker, Westfield, IN (US); Nate Cooper, Avon, IN (US); Nathan Ottow, Indianapolis, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 514 days.

(21) Appl. No.: 15/165,404

(22) Filed: May 26, 2016

(65) Prior Publication Data

US 2017/0342994 A1 Nov. 30, 2017

(51) Int. Cl.

| | |
|---|---|
| ***F01D 11/22*** | (2006.01) |
| ***F04D 29/16*** | (2006.01) |
| ***F01D 11/24*** | (2006.01) |
| ***F04D 27/02*** | (2006.01) |
| ***F04D 29/62*** | (2006.01) |
| *F01D 11/18* | (2006.01) |
| *F01D 11/08* | (2006.01) |
| *F04D 29/42* | (2006.01) |

(52) U.S. Cl.

CPC ..... *F04D 29/162* (2013.01); *F01D 11/24* (2013.01); *F04D 27/0246* (2013.01); *F04D 29/622* (2013.01); *F01D 11/08* (2013.01); *F01D 11/18* (2013.01); *F01D 11/22* (2013.01); *F04D 29/4206* (2013.01); *F04D 29/624* (2013.01)

(58) Field of Classification Search

CPC ..... F01D 11/22; F01D 11/24; F01D 11/20; F01D 11/14; F04D 29/162; F04D 29/622; F04D 29/284; F04D 29/4206; F04D 29/68; F04D 29/681; F04D 27/0246

See application file for complete search history.

(56) References Cited

U.S. PATENT DOCUMENTS

| | | | |
|---|---|---|---|
| 4,264,271 | A | 4/1981 | Libertini |
| 6,273,671 | B1 | 8/2001 | Ress, Jr. |
| 8,087,880 | B2 | 1/2012 | Karafillis et al. |
| 2008/0134659 | A1 | 6/2008 | Schwarz et al. |

*Primary Examiner* — Justin D Seabe
*Assistant Examiner* — Behnoush Haghighian
(74) *Attorney, Agent, or Firm* — Duane Morris LLP

(57) ABSTRACT

A system for controlling the clearance distance between an impeller blade tip of a centrifugal compressor and a radially inner surface of an impeller shroud in a turbine engine. The system comprises a thermal driver coupled between the impeller shroud and engine casing by hinged linkages. The thermal driver includes an annular ring and annular seal which together define thermal driver cavity. Relatively warm or relatively cool air supplied to the thermal driver cavity cause expansion and contraction, respectively, of the annular ring which is translated by linkages into axially forward and aft motion, respectively.

20 Claims, 8 Drawing Sheets

IMPELLER SHROUD WITH THERMAL ACTUATOR FOR CLEARANCE CONTROL IN A CENTRIFUGAL COMPRESSOR

FIELD OF THE DISCLOSURE

The present invention relates generally to turbine engines having centrifugal compressors and, more specifically, to control of clearances between an impeller and a shroud of a centrifugal compressor.

BACKGROUND

Centrifugal compressors are used in turbine machines such as gas turbine engines to provide high pressure working fluid to a combustor. In some turbine machines, centrifugal compressors are used as the final stage in a multi-stage high-pressure gas generator.

FIG. 1 is a schematic and sectional view of a centrifugal compressor system 100 in a gas turbine engine. One of a plurality of centrifugal compressor blades 112 is illustrated. As blade 112 rotates, it receives working fluid at a first pressure and ejects working fluid at a second pressure which is higher than first pressure. The radially-outward surface of each of the plurality of compressor blades 112 comprises a compressor blade tip 113.

An annular shroud 120 encases the plurality of blades 112 of the impeller. The gap between a radially inner surface 122 of shroud 120 and the impeller blade tips 113 is the blade tip clearance 140 or clearance gap. Shroud 120 may be coupled to a portion of the engine casing 131 directly or via a first mounting flange 133 and second mounting flange 135.

Gas turbine engines having centrifugal compressor systems 100 such as that illustrated in FIG. 1 typically have a blade tip clearance 140 between the blade tips 113 and the shroud 120 set such that a rub between the blade tips 113 and the shroud 120 will not occur at the operating conditions that cause the highest clearance closure. A rub is any impingement of the blade tips 113 on the shroud 120. However, setting the blade tip clearance 140 to avoid blade 112 impingement on the shroud 120 during the highest clearance closure transient may result in a less efficient centrifugal compressor because working fluid is able to flow between the blades 112 and shroud 120 thus bypassing the blades 112. This working fluid constitutes leakage. In the centrifugal compressor system 100 of FIG. 1, blade tip clearances 140 cannot be adjusted because shroud 120 is rigidly mounted to the engine casing 131.

It is known in the art to dynamically change blade tip clearance 140 to reduce leakage of a working fluid around the blade tips 113. Several actuation systems for adjusting blade tip clearance 140 during engine operation have been developed. These systems often include complicated linkages, contribute significant weight, and/or require a significant amount of power to operate. Thus, there continues to be a demand for advancements in blade clearance technology to minimize blade tip clearance 140 while avoiding rubs.

The present application discloses one or more of the features recited in the appended claims and/or the following features which, alone or in any combination, may comprise patentable subject matter.

SUMMARY

According to an aspect of the present disclosure, a compressor shroud assembly in a turbine engine having a dynamically moveable impeller shroud for encasing a rotatable centrifugal compressor and maintaining a clearance gap between the shroud and the rotatable centrifugal compressor, said assembly comprises: a static compressor casing; a thermal actuator comprising one or more linkage assemblies mounted to said casing and being spaced around the circumference thereof, and an annular thermal driver mounted to said linkage assemblies; and an impeller shroud slidably coupled at a forward end to said casing and mounted proximate an aft end to said linkage assemblies, said impeller shroud moving relative to the rotatable centrifugal compressor in an axial direction while substantially maintaining a radial alignment when said thermal actuator is actuated.

In some embodiments the linkage assemblies each comprise a forward linkage pivotally mounted to said casing, an aft linkage pivotally mounted to said shroud, and a central linkage pivotally mounted to said forward and aft linkages. In some embodiments the annular thermal driver is mounted to said central linkage and is adapted to radially expand or contract responsive to exposure to an actuating temperature, said annular thermal driver expanding radially to effect movement of said shroud in an axially forward direction, said annular thermal driver contracting radially to effect movement of said shroud in an axially aft direction. In some embodiments the annular thermal driver is exposed to an actuating temperature by exposure to one or more of an actuating air, electrical heating elements, lubricant flow, or fluid flow. In some embodiments the annular driver is exposed to air drawn from the core air of the turbine engine. In some embodiments the central linkage comprises an annular thermal drive ring adapted to axially expand or contract responsive to exposure to an actuating temperature, said annular thermal drive ring contracting axially to effect movement of said shroud in an axially forward direction, said annular thermal drive ring expanding axially to effect movement of said shroud in an axially aft direction. In some embodiments the annular thermal drive ring is exposed to an actuating temperature by exposure to one or more of an actuating air, electrical heating elements, lubricant flow, or fluid flow. In some embodiments the annular thermal drive ring is exposed to air drawn from the core air of the turbine engine. In some embodiments the slidable coupling between said shroud and said casing is dimensioned to maintain an air boundary during the full range of axial movement of said shroud.

In some embodiments the compressor shroud assembly further comprises one or more sensors for measuring the temperature in a cavity at least partly defined by said annular thermal driver, said annular thermal driver being exposed to warmer or cooler actuating temperatures in response to the measured temperature in said cavity. In some embodiments the compressor shroud assembly further comprises one or more sensors for measuring the clearance gap between said shroud and the rotatable centrifugal compressor, said annular thermal driver being exposed to warmer or cooler actuating temperatures in response to the clearance gap measure by the one or more sensors. In some embodiments the compressor shroud assembly further comprises one or more sensors for measuring the temperature in a cavity at least partly defined by said annular thermal drive ring, said annular thermal drive ring being exposed to warmer or cooler actuating temperatures in response to the measured temperature in said cavity.

According to another aspect of the present disclosure, a compressor shroud assembly in a turbine engine having a dynamically moveable impeller shroud for encasing a rotatable centrifugal compressor and maintaining a clearance gap between the shroud and the rotatable centrifugal compressor, said assembly comprises: a static compressor casing; a thermal actuator comprising one or more linkage assemblies mounted to said casing and being spaced around the circumference thereof, and an annular thermal driver mounted to said linkage assemblies; and an impeller shroud mounted at a forward end to said casing and mounted proximate an aft end to said linkage assemblies, said impeller shroud moving relative to the rotatable centrifugal compressor in a cantilevered manner from said forward end thereof when said thermal actuator is actuated.

In some embodiments the linkage assemblies each comprise a forward linkage pivotally mounted to said casing, an aft linkage pivotally mounted to said shroud, and a central linkage pivotally mounted to said forward and aft linkages; and wherein said annular thermal driver is mounted to said central linkage and adapted to radially expand or contract responsive to exposure to an actuating temperature, said thermal driver expanding radially to effect movement of said shroud in an axially forward direction, said thermal driver contracting radially to effect movement of said shroud in an axially aft direction.

According to another aspect of the present disclosure, a method of dynamically changing a clearance gap between a rotatable centrifugal compressor and a shroud encasing the rotatable centrifugal compressor, said method comprises: mounting a thermal driver to a static casing; mounting a shroud to the thermal driver; and actuating the thermal driver to thereby move the shroud relative to a rotatable centrifugal compressor.

In some embodiments the method further comprises providing actuating air actuate the thermal driver. In some embodiments the actuating air is one of inducer air, exducer air, intermediate stage compressor air, or discharge air from the centrifugal compressor. In some embodiments the method further comprises slidably coupling the forward end of the shroud to the casing, wherein the shroud moves relative to the rotatable centrifugal compressor in an axial direction while substantially maintaining a radial alignment when the thermal driver is actuated. In some embodiments the method further comprises sensing the fluid temperature in a cavity at least partly defined by said thermal driver and actuating the thermal driver in response to the sensed fluid temperature. In some embodiments the method further comprises sensing the clearance gap between the rotatable centrifugal compressor and the shroud and actuating the thermal driver in response to the sensed clearance gap.

BRIEF DESCRIPTION OF THE DRAWINGS

The following will be apparent from elements of the figures, which are provided for illustrative purposes and are not necessarily to scale.

Figure 1:
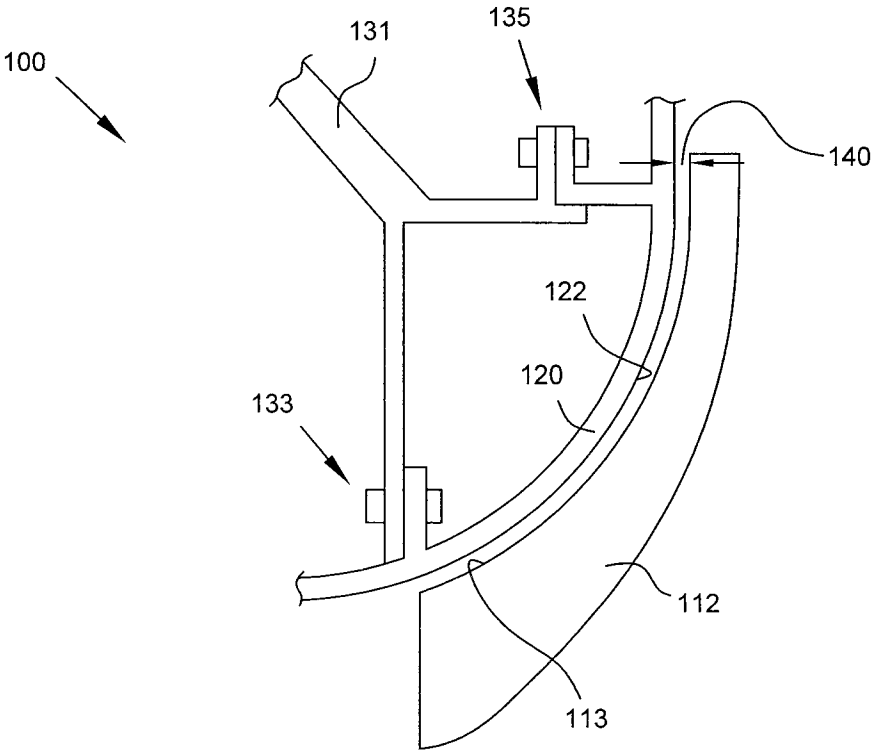
FIG. 1 Prior Art
FIG. 1 is a schematic and sectional view of a centrifugal compressor system in a gas turbine engine.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents embodiments to overcome the aforementioned deficiencies in clearance control systems and methods. More specifically, the present disclosure is directed to a system for clearance control of blade tip clearance which avoids the complicated linkages, significant weight penalties, and/or significant power requirements of prior art systems. The present disclosure is directed to a system which employs a thermal actuator to cause axial deflection of an impeller shroud.

Figure 2A:
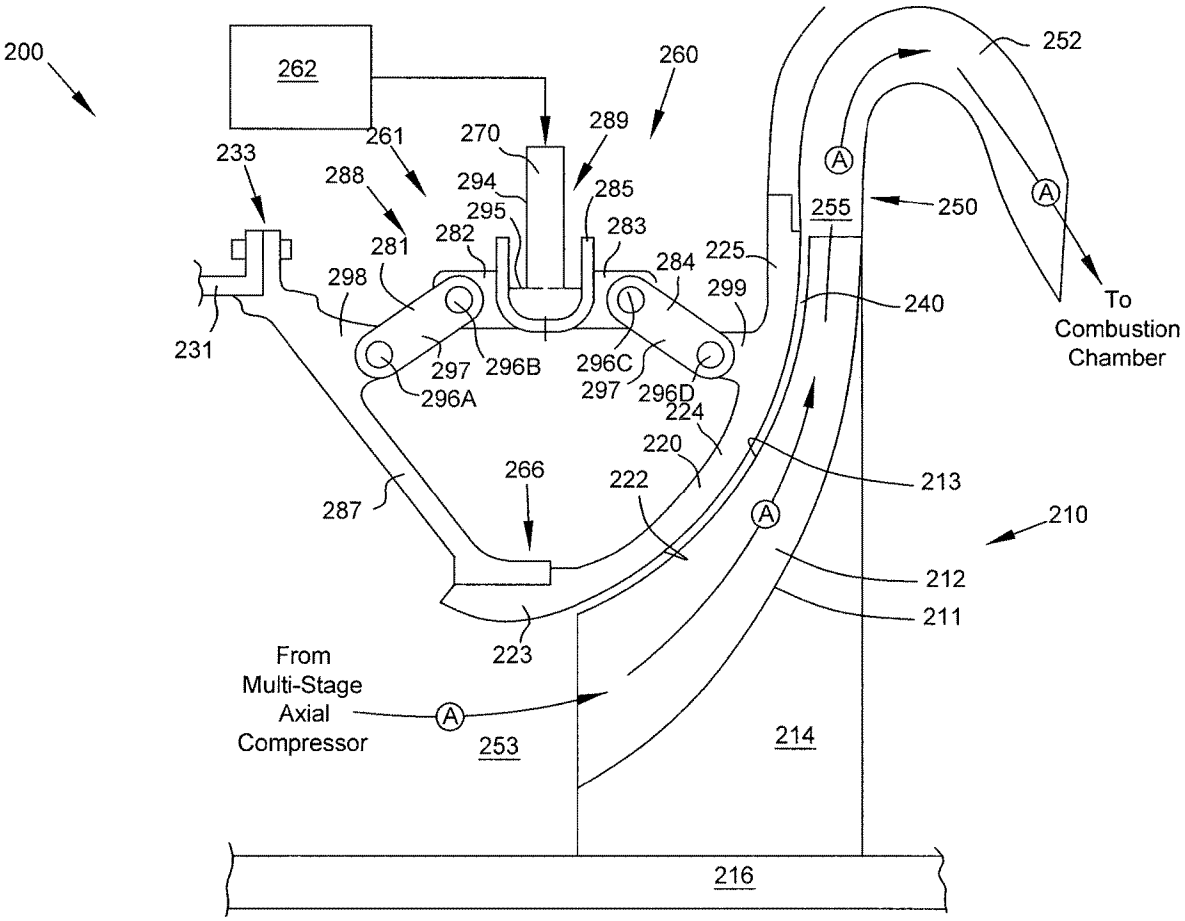
FIG. 2A is a schematic and sectional view of a centrifugal compressor system having a clearance control system in accordance with some embodiments of the present disclosure.

FIG. 2A is a schematic and sectional view of a centrifugal compressor system 200 having a clearance control system 260 in accordance with some embodiments of the present disclosure. Centrifugal compressor system 200 comprises centrifugal compressor 210 and clearance control system 260.

The centrifugal compressor 210 comprises an annular impeller 211 having a plurality of centrifugal compressor blades 212 extending radially from the impeller 211. The impeller 211 is coupled to a disc rotor 214 which is in turn coupled to a shaft 216. Shaft 216 is rotatably supported by at least forward and aft shaft bearings (not shown) and may rotate at high speeds. The radially-outward surface of each of the compressor blades 212 constitutes a compressor blade tip 213.

As blade 212 rotates, it receives working fluid at an inlet pressure and ejects working fluid at a discharge pressure which is higher than the inlet pressure. Working fluid (e.g. air in a gas turbine engine) is typically discharged from a multi-stage axial compressor (not shown) prior to entering the centrifugal compressor 210. Arrows A illustrate the flow of working fluid through the centrifugal compressor 210. Working fluid enters the centrifugal compressor 210 from an axially forward position 253 at an inlet pressure. Working fluid exits the centrifugal compressor 210 at an axially aft and radially outward position 255 at a discharge pressure which is higher than inlet pressure.

Working fluid exiting the centrifugal compressor 210 passes through a diffusing region 250 and then through a deswirl cascade 252 prior to entering a combustion chamber (not shown). In the combustion chamber, the high pressure working fluid is mixed with fuel and ignited, creating combustion gases that flow through a turbine (not shown) for work extraction.

In one embodiment, the clearance control system 260 comprises an air source 262, a thermal driver 289, at least one linkage assembly 288, and an annular shroud 220. Clearance control system 260 can also be referred to as a compressor shroud assembly.

Air source 262 provides air to thermal driver cavity 286. In some embodiments air source 262 receives air from more than one location and uses a multi-source regulator valve or mixing valve to send air of an appropriate temperature to thermal driver cavity 286. For example, in some embodiments air source 262 receives relatively cool air from earlier compressor stages and relatively warm air from the discharge of centrifugal compressor 210. When cooling air is desired to be applied to thermal driver cavity 286, as explained below, air source 262 sends the relatively cool air received from earlier compressor stages. When heating air is desired to be applied to thermal driver cavity 286, as explained below, air source 262 sends the relatively warm air received from centrifugal compressor 210 discharge.

Potential sources of cooling air include ambient air, low pressure compressor discharge air, inter-stage compressor air, and cooling coil or heat exchanger air. Potential sources of warming air include discharge air of the centrifugal compressor 210, core engine air, inter-stage turbine air, cooling coil or heat exchanger air, electrically-powered heating coil air, and engine exhaust. In some embodiments warming and/or cooling air flow is replaced by fluid flow such as the flow of a lubricating fluid to provide an actuating temperature to thermal driver 289.

In some embodiments air source 262 receives air from multiple sources and mixes them to achieve a desired temperature prior to applying the air to thermal driver cavity 286.

Thermal driver 289 comprises an annular ring 285 and annular seal 295 which together define thermal driver cavity 286. In some embodiments thermal driver 289 further comprises a thermal feed air tube 294. Annular ring 285 is formed from a thermally-responsive material such that excitement by application of relatively cool or relatively warm air causes contraction or expansion, respectively. In other words, thermal driver 289 radially expands or contracts when exposed to an actuating temperature. In some embodiments, annular ring 285 has a U-shaped radial cross section. In some embodiments, annular ring 285 and annular seal 295 comprise a single annular tube, having one or more thermal feed air tubes 294 coupled thereto.

Annular seal 295 is coupled to annular ring 285 to form an annular thermal driver cavity 286. This cavity 286 is in fluid communication with the interior 270 of at least one thermal feed air tube 294. In some embodiments, more than one thermal feed air tube 294 are disposed circumferentially around the annular ring 285 and fluidly communicate with the annular thermal driver cavity 286. In some embodiments one or more sensors may be disposed in or in fluid communication with cavity 286 to measure the fluid temperature or fluid pressure of cavity 286. Thermal driver 289 may be exposed to warmer or cooler actuating temperatures based on the measured fluid temperature or fluid pressure of cavity 286.

Linkage assembly 288 comprises a forward linkage 281, forward translator 282, aft translator 283, and aft linkage 284. Forward linkage 281 and forward translator 282 are coupled between a forward casing member 287 and thermal driver 289. Forward linkage 281 is pivotally mounted to the forward casing member 287. Aft translator 283 and aft linkage 284 are coupled between thermal driver 289 and shroud 220. Aft linkage 284 is pivotally mounted to the shroud 220. In some embodiments, a central linkage comprises forward translator 282, aft translator 283, and thermal driver 289. In some embodiments, more or fewer linkages are used in linkage assembly 288.

Each of forward linkage 281 and aft linkage 284 comprise a pair of pins 296 and a linkage member 297. Each pin 296 passes through both the respective linkage member 297 and respective component which is being coupled to the linkage member 297. For example, pin 296A passes through the linkage member 297 of forward linkage 281 and through an axial extension 298 of forward casing member 287, thus forming a pin joint or hinge between forward casing member 287 and forward linkage 281. Similar pin joints are formed between forward linkage 281 and forward translator 282 (by pin 296B), between aft translator 283 and aft linkage 284 (by pin 296C), and between aft linkage 284 and an axial protrusion 299 from shroud 220.

Forward translator 282 and aft translator 283 are coupled to annular ring 285 of the thermal driver 289. Thus, the thermal contraction and expansion of annular ring 285, caused by the application of relatively cool or relatively warm air to the thermal driver cavity 286, causes relative motion of forward translator 282 and aft translator 283.

Forward casing arm 287 is coupled to a portion of engine casing 231 at first mounting flange 233. In some embodiments, the portion of engine casing 231 is the compressor casing of a multi-stage axial compressor disposed forward of centrifugal compressor 210.

In some embodiments linkage assembly 288 is annular. In other embodiments, a plurality of discrete linkage assemblies 288 are circumferentially disposed about shroud 220 and each act independently upon the shroud 220.

In some embodiments, a thermal actuator 261 comprises an annular ring 285 and annular seal 295 which together define thermal driver cavity 286 and at least one linkage assembly 288. In some embodiments thermal actuator 261 may further comprise at least one thermal feed air tube 294. In some embodiments, at least three linkage assemblies 288 may be spaced around the circumference of shroud 220. In some embodiments, at least three linkage assemblies 288 may be spaced around the circumference of casing 231.

Shroud 220 is a dynamically moveable impeller shroud. Shroud 220 encases the plurality of blades 212 of the centrifugal compressor 210. Shroud 220 comprises a forward end portion 223 terminating at sliding joint 266, a central portion 224, and a aft end portion 225.

In some embodiments aft end portion 225 is defined as the radially outward most third of shroud 220. In other embodiments aft end portion 225 is defined as the radially outward most quarter of shroud 220. In still further embodiments aft end portion 225 is defined as the radially outward most tenth of shroud 220. In embodiments wherein axial protrusion 299 extends axially forward from aft end portion 225, these various definitions of aft end portion 225 as either the final third, quarter, or tenth of shroud 220 provide for the various radial placements of axial protrusion 299 relative to shroud 220.

Sliding joint 266 comprises forward casing arm 287 coupled to forward end portion 223 of shroud 220. Sliding joint 266 is adapted to allow sliding displacement between casing arm 287 and forward end portion 223. In some embodiments one or more surfaces of forward end portion 223 and/or casing arm 287 comprise a lubricating surface to encourage sliding displacement between these components. In some embodiments the lubricating surface is a coating.

The gap between a surface 222 of shroud 220 which faces the impeller 211 and the impeller blade tips 213 is the blade tip clearance 240. In operation, thermal, mechanical, and pressure forces act on the various components of the centrifugal compressor system 200 causing variation in the blade tip clearance 240. For most operating conditions, the blade tip clearance 240 is larger than desirable for the most efficient operation of the centrifugal compressor 210. These relatively large clearances 240 avoid rubbing between blade 212 and the surface 222 of shroud 220, but also result in high leakage rates of working fluid past the impeller 211. It is therefore desirable to control the blade tip clearance 240 over a wide range of steady state and transient operating conditions. The disclosed clearance control system 260 provides blade tip clearance 240 control by positioning shroud 220 relative to blade tips 213.

Figure 2B:
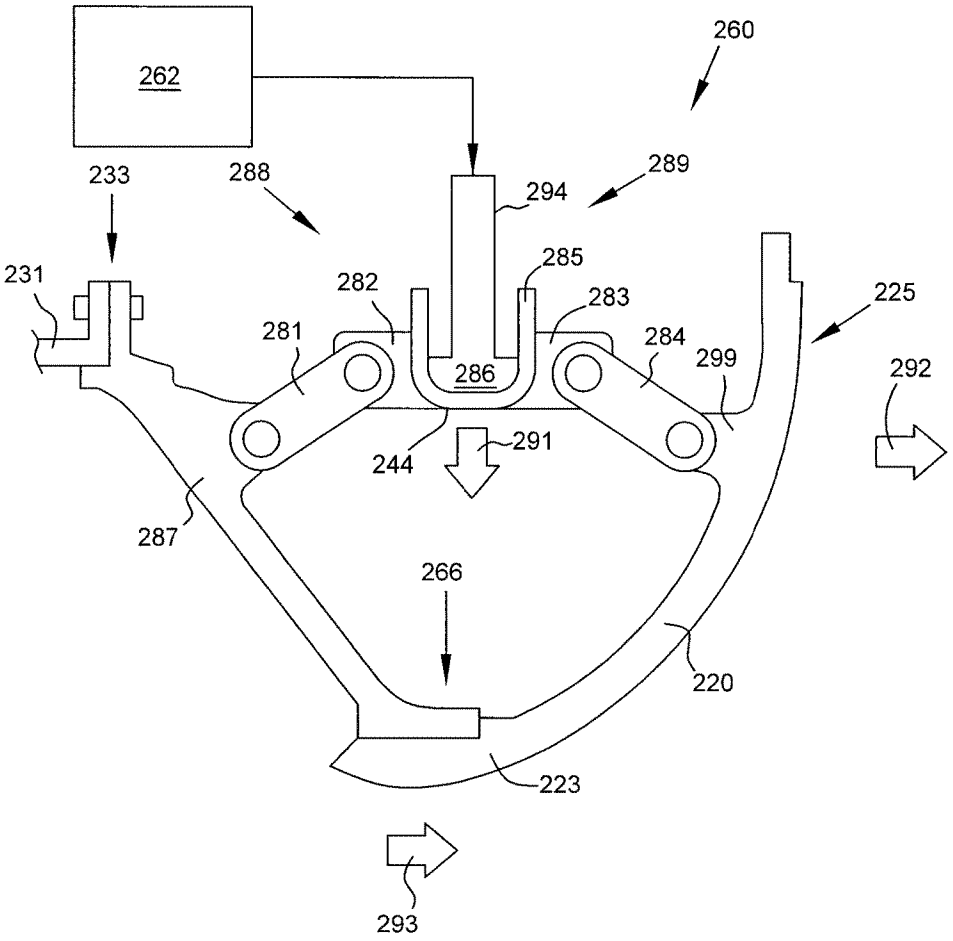
FIG. 2B is an enlarged schematic and sectional view of the clearance control system illustrated in FIG. 2A, in accordance with some embodiments of the present disclosure.

FIG. 2B is an enlarged schematic and sectional view of the clearance control system 260 illustrated in FIG. 2A, in accordance with some embodiments of the present disclosure. The operation of clearance control system 260 will be discussed with reference to FIG. 2B.

In some embodiments during operation of centrifugal compressor 210 blade tip clearance 240 is monitored by periodic or continuous measurement of the distance between surface 222 and blade tips 213 using a sensor or sensors positioned at selected points along the length of surface 222. When clearance 240 is larger than a predetermined threshold, it may be desirable to reduce the clearance 240 to prevent leakage and thus improve centrifugal compressor efficiency. Actuating temperature of thermal driver 286 may be adjusted based on the measured blade tip clearance 240.

In other embodiments, engine testing may be performed to determine blade tip clearance 240 for various operating parameters and a piston chamber 274 pressure schedule is developed for different modes of operation. For example, based on clearance 240 testing, piston chamber 274 pressures may be predetermined for cold engine start-up, warm engine start-up, steady state operation, and max power operation conditions. As another example, a table may be created based on blade tip clearance 240 testing, and piston chamber 274 pressure is adjusted according to operating temperatures and pressures of the centrifugal compressor 210. Thus, based on monitoring the operating conditions of the centrifugal compressor 210 such as inlet pressure, discharge pressure, and/or working fluid temperature, a desired blade tip clearance 240 is achieved according to a predetermined schedule of pressures for piston chamber 274.

Regardless of whether clearance 240 is actively monitored or controlled via a schedule, in some operating conditions it may be desirable to reduce the clearance 240 in order to reduce leakage past the centrifugal compressor 210. In order to reduce the clearance 240, relatively cool air is supplied from air source 262 to thermal driver cavity 286 via thermal feed air tube 294. As relatively cool air fills the annular thermal driver cavity 286 it causes contraction of annular ring 285. This contraction reduces the circumference of the ring 285, such that radially inner surface 244 moves in a radially inward direction as indicated by arrow 291.

Forward translator 282 and aft translator 283 are coupled to ring 285 and therefore also move in a radially inward direction. This radially inward motion causes an elongation of linkage assembly 288, as forward linkage 281 and aft linkage 284 are pushed by forward translator 282 and aft translator 283, respectively, in a radially inward direction. The pin joints created by pins 296A, 296B, 296C, and 296D cause this radially inward motion to be translated to axial motion.

With forward linkage 281 coupled to forward casing arm 287, which is in turn rigidly coupled, or "grounded", to casing 231 via mounting flange 233, motion in the axially forward direction is prohibited. Thus, linkage assembly 288 translates the radially inward motion of ring 285 into an axially aft motion.

Aft linkage 284 acts on axial protrusion 299, causing aft end portion 225 of shroud 220 to move in an axially aft direction as indicated by arrow 292. This movement of aft end portion 225 is translated to a similar axially aft movement at the sliding joint 266, where forward end portion 223 is displaced in an axially aft direction relative to forward casing arm 287 as indicated by arrow 293. In other words, expansion and contraction of annular ring 285 results in axial movement of shroud 220 while substantially maintaining a radial alignment.

The axially aft movement of shroud 220 caused by ring 285 contraction results in shroud 220 moving closer to blade tips 213, thus reducing the clearance 240 and leakage. During many operating conditions this deflection of shroud 220 in the direction of blade tips 213 is desirable to reduce leakage and increase compressor efficiency.

Where monitoring of blade tip clearance 240 indicates the need for an increase in the clearance 240, the process described above is reversed. Relatively warmer air is supplied from air source 262 to thermal driver cavity 286, causing expansion of ring 285. This expansion results in a radially outward movement of ring 285, forward translator 282, and aft translator 283, which is in turn translated to an axially forward motion by linkage assembly 288. Aft end portion 225 is pulled by linkage assembly 288 in an axially forward direction, and shroud 220 moves in an axially forward direction accordingly. Sliding displacement at sliding joint 266 allows forward end portion 223 to move axially forward relative to forward casing arm 287. Thus, by applying relatively warmer air to thermal driver cavity 286, shroud 220 is moved axially forward away from blade tips 213, increasing blade tip clearance 240. Slidable coupling 266 is dimensioned such that an air boundary is maintained through the full range of axial movement of shroud 220.

Figure 3:
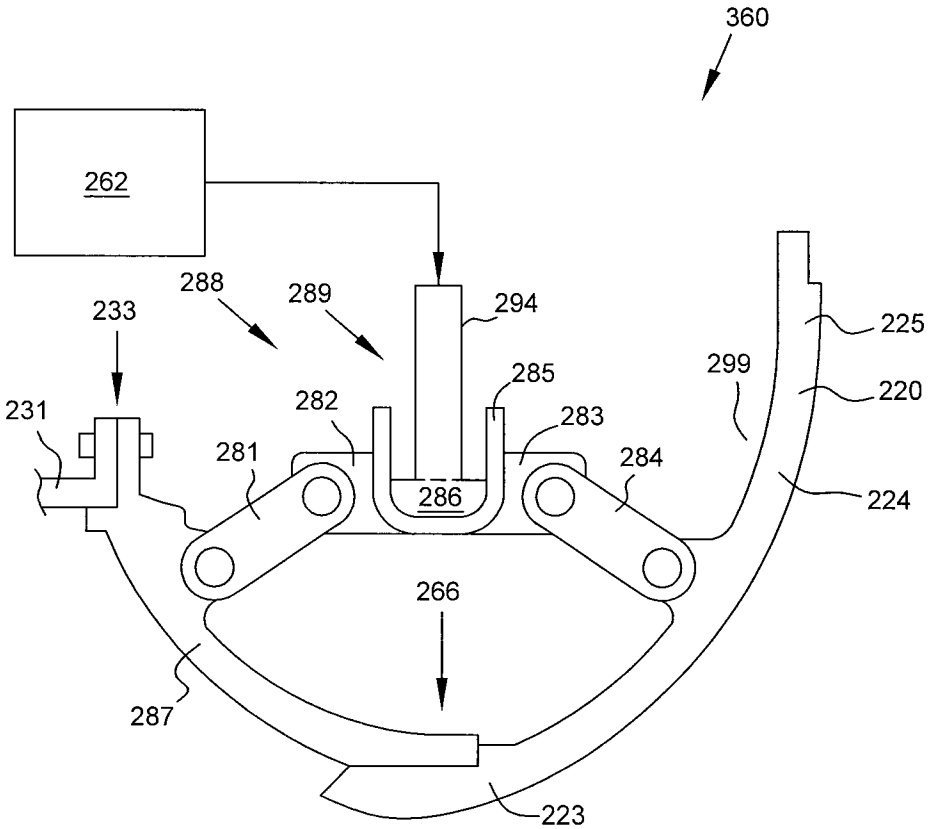
FIG. 3 is a schematic and sectional view of another embodiment of a clearance control system in accordance with the present disclosure.

FIG. 3 is a schematic and sectional view of another embodiment of a clearance control system 360 in accordance with the present disclosure. In the embodiment of FIG. 3, axial protrusion 299 extends from shroud 220 at central portion 224 as opposed to aft end portion 225.

In some embodiments central portion 224 is defined as the centermost third of shroud 220. In other embodiments central portion 224 is defined as the centermost quarter of shroud 220. In still further embodiments central portion 224 is defined as the centermost tenth of shroud 220. In embodiments wherein axial protrusion 299 extends axially forward from central portion 224, these various definitions of central portion 224 as either the centermost third, quarter, or tenth of shroud 220 provide for the various radial placements of axial protrusion 299 relative to shroud 220.

Although the embodiment of FIG. 3 operates in substantially the same manner as the clearance control system 260 of FIG. 2, as described above, it should be noted that in the embodiment of FIG. 3 the shroud 220 is subject to less flexion force due to the central placement of axial protrusion 299 and its connection to linkage assembly 288. In other words, moving the axial protrusion 299 more centrally vice at the aft end portion 225 results in axially aft directional force being applied at central portion 224 and less flexing of the shroud 220.

Figure 4:
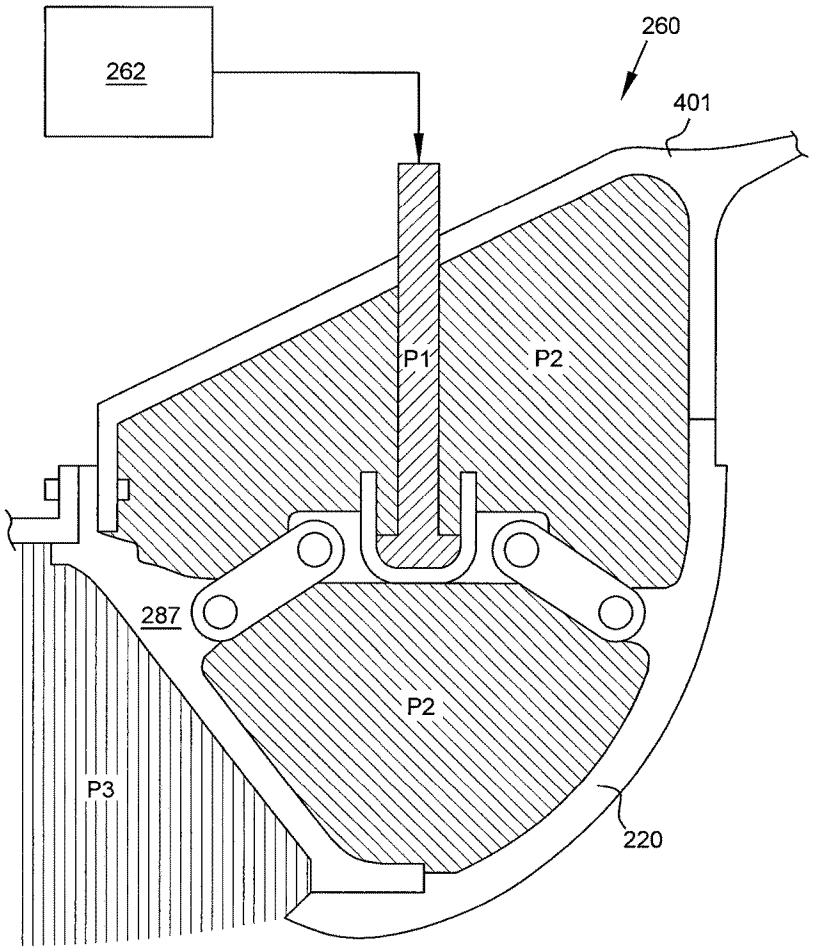
FIG. 4 is a schematic and sectional view of the pressure regions of a clearance control system in accordance with some embodiments of the present disclosure.

FIG. 4 is a schematic and sectional view of the pressure regions P1, P2, and P3 of a clearance control system 260 in accordance with some embodiments of the present disclosure. A first pressure region P1 is defined as thermal driver cavity 286 and the interior of thermal feed air tube 294. A second pressure region P2 is defined between shroud 220, forward casing arm 287, and outward casing member 401. A third pressure region P3 is disposed axially forward of forward casing arm 287.

In some embodiments, second pressure region P2 is maintained at or near atmospheric pressure, meaning that region P2 is neither sealed nor pressurized. However, relatively low pressures in region P2 creates a large differential pressure across shroud 220 (i.e. differential pressure between the pressure of region P2 and the pressure of the centrifugal compressor 210) such that it is more difficult to deflect or cause axial movement in shroud 220.

In other embodiments second pressure region P2 is sealed and pressurized to reduce the differential pressure across the shroud 220. For example, in some embodiments second pressure region P2 is pressurized using one of inducer air, exducer air, intermediate stage compressor air, or discharge air from the centrifugal compressor 210. The force required to move shroud 220 is greatly reduced due to the lower differential pressure across the shroud 220.

In some embodiments third pressure region P3 is pressurized with inducer air and is therefore at a lower pressure than second pressure region P2.

Figure 5:
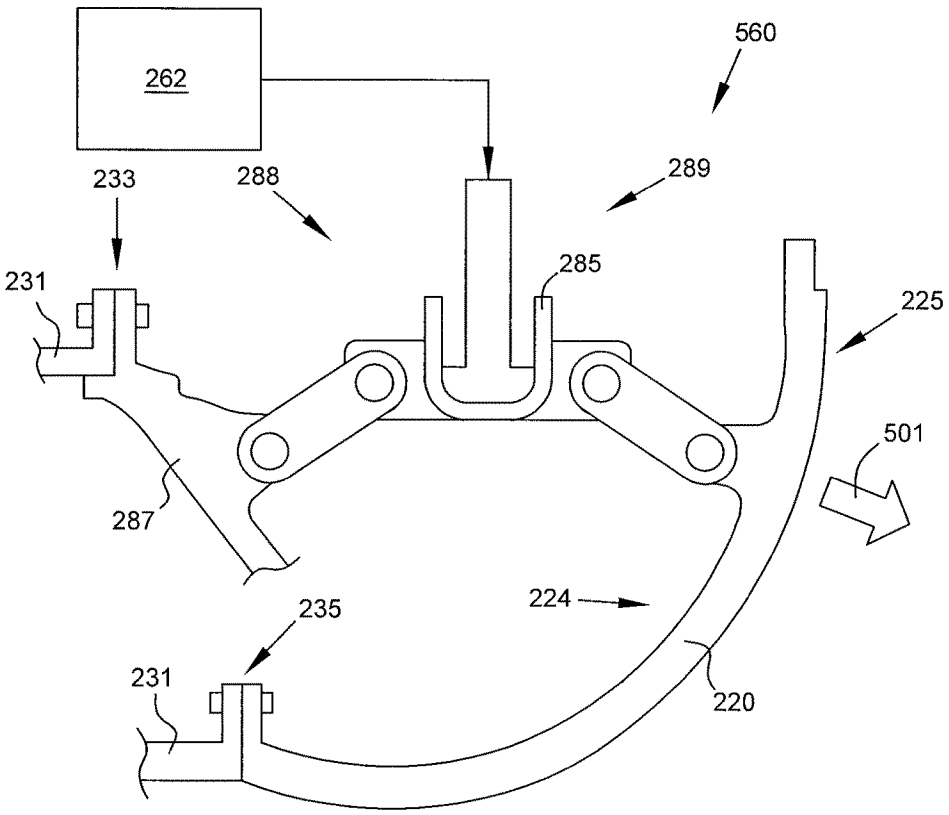
FIG. 5 is a schematic and sectional view of another embodiment of a clearance control system in accordance with the present disclosure.

FIG. 5 is a schematic and sectional view of another embodiment of a clearance control system 560 in accordance with the present disclosure. Clearance control system 560 includes shroud 220 which comprises an extended forward end portion 503, central portion 224, and aft end portion 225. Extended forward end portion 503 is coupled to casing 231 at mounting flange 235. Translation of the contraction of ring 285 by linkage assembly 288 results in axially aft movement of aft end portion 225. Without a sliding joint 266, the shroud 220 flexes in an axially aft and radially inward direction as indicated with arrow 501, toward the blade 212. Having shroud 220 mounted to casing 231 results in a cantilevered motion as shroud 220 deflects in a radially inward and axially aft direction as indicated by arrow 501.

Figure 6:
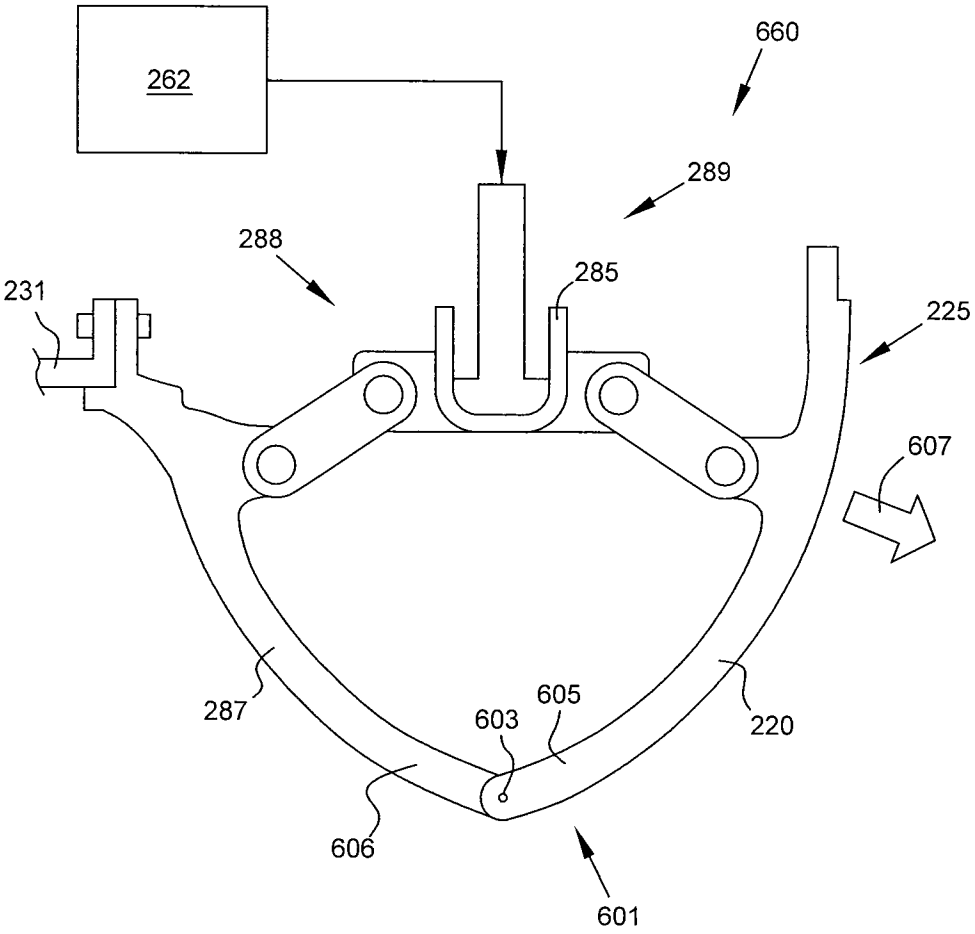
FIG. 6 is a schematic and sectional view of another embodiment of a clearance control system in accordance with the present disclosure.

FIG. 6 is a schematic and sectional view of another embodiment of a clearance control system 660 in accordance with the present disclosure. Clearance control system 660 has a hinged joint 601 comprising an annular pin 603 received by a proximal portion 605 of shroud 220 and a receiving portion 606 of forward casing arm 287.

As with the embodiment of FIG. 5, translation of the contraction of ring 285 by linkage assembly 288 results in axially aft movement of aft end portion 225. This movement causes shroud 220 to deflect and, with hinged joint 601, to pivot about the annular pin 603 causing motion in a radially inward and axially aft direction as indicated by arrow 607.

Figure 7:
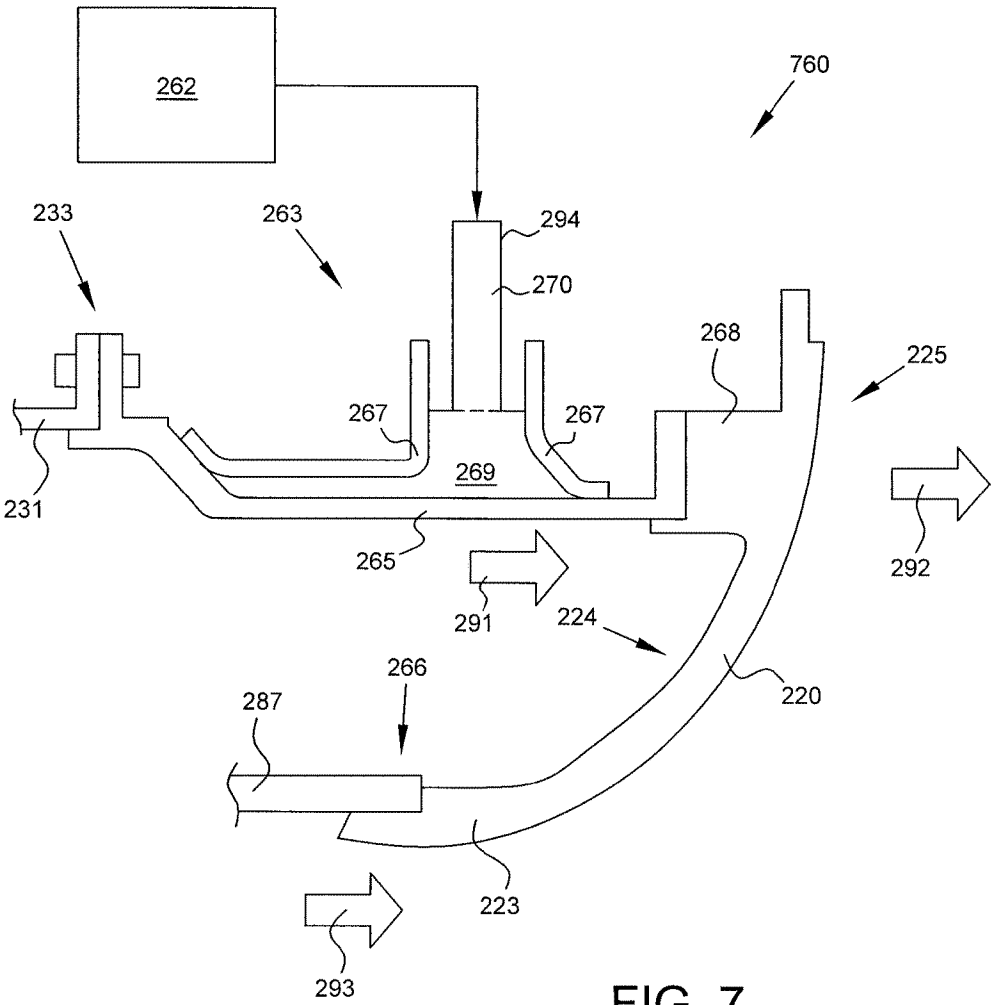
FIG. 7 is a schematic and sectional view of another embodiment of a clearance control system in accordance with the present disclosure.

FIG. 7 is a schematic and sectional view of another embodiment of a clearance control system 760 in accordance with the present disclosure. Clearance control system 760 comprises an air source 262, a thermal drive assembly 263, and an annular shroud 220.

Air source 262 and annular shroud 220 are substantially the same, and operates in substantially the same manner, as discussed above with reference to FIG. 2.

Thermal drive assembly 263 comprises an annular thermal drive ring 265, a drive ring sleeve 267, and thermal feed air tube 294. Thermal drive ring 265 is coupled between a portion of the engine casing 231 at mounting flange 233 and a mount platform 268 extending axially forward from the aft end portion 225 of shroud 220. Thermal drive ring 265 is formed from a thermally-responsive material such that excitement by application of relatively cool or relatively warm air causes contraction or expansion, respectively. Thermal drive ring 265 is sized to meet the actuation needs of clearance control system 760.

Drive ring sleeve 267 is coupled to thermal drive ring 265 to form an annular cavity 269. This cavity 269 is in fluid communication with the interior 270 of at least one thermal feed air tube 294. In some embodiments, more than one thermal feed air tube 294 are disposed circumferentially around the thermal drive ring 265 and fluidly communicate with the annular cavity 269.

Regardless of whether clearance 240 is actively monitored or controlled via a schedule, in some operating conditions it will be desirable to reduce the clearance 240 in order to reduce leakage past the centrifugal compressor 210. In order to reduce the clearance 240, relatively warm air is supplied from air source 262 to annular cavity 269 via thermal feed air tube 294. As relatively warm air fills the annular cavity 269 it causes expansion, primarily in the axial direction, of thermal drive ring 265. This axial expansion is anchored, or "grounded", against the engine casing 231 such that axial expansion or movement is prohibited in the axially forward direction. Thus, the axial expansion of thermal drive ring 265 acts in the axially aft direction as illustrated by arrow 291, imparting a force on the mount platform 268 and thus on the aft end portion 225 of shroud 220 as illustrated by arrow 292. This movement of aft end portion 225 is translated to a similar axially aft movement at the sliding joint 266, where forward end portion 223 is displaced in an axially aft direction relative to forward casing arm 287 as indicated by arrow 293.

The axially aft movement of shroud 220 caused by expansion of ring 265 results in shroud 220 moving closer to blade tips 213, thus reducing the clearance 240 and leakage. During many operating conditions this deflection of shroud 220 in the direction of blade tips 213 is desirable to reduce leakage and increase compressor efficiency.

Where monitoring of blade tip clearance 240 indicates the need for an increase in the clearance 240, the process described above is reversed. Relatively cooler air is supplied from air source 262 to annular cavity 269, causing contraction of ring 265. This contraction is primarily in the axial direction and results in the axially forward movement of ring 265 and mount platform 268. Aft end portion 225 is pulled in an axially forward direction; and shroud 220 moves in an axially forward direction accordingly. Sliding displacement at sliding joint 266 allows forward end portion 223 to move axially forward relative to forward casing arm 287. Thus, by applying relatively cooler air to annular cavity 269, shroud 220 is moved axially forward away from blade tips 213, increasing blade tip clearance 240.

In some embodiments alternative clearance control system 760 has a modified placement of the linkage assembly to shroud connection, similar to the embodiment disclosed with reference to FIG. 3 above. In some embodiments alternative clearance control system 760 omits the sliding joint, similar to the embodiment disclosed with reference to FIG. 5 above. In some embodiments alternative clearance control system 760 has a hinged joint, similar to the embodiment disclosed with reference to FIG. 6 above.

The present disclosure provides many advantages over previous systems and methods of controlling blade tip clearances. The disclosed clearance control systems allow for tightly controlling blade tip clearances, which are a key driver of overall compressor efficiency. Improved compressor efficiency results in lower fuel consumption of the engine. The use of thermal gradients in the engine as an actuator for the impeller shroud additionally eliminates the need for an actuator external to the engine. Additionally, the present disclosure eliminates the use of complicated linkages, significant weight penalties, and/or significant power requirements of prior art systems.

Although examples are illustrated and described herein, embodiments are nevertheless not limited to the details shown, since various modifications and structural changes may be made therein by those of ordinary skill within the scope and range of equivalents of the claims.

What is claimed is:

1. A compressor shroud assembly in a turbine engine comprising:

a static compressor casing;

a thermal actuator comprising:

one or more linkage assemblies mounted to said casing and being spaced around the circumference thereof;

an annular thermal drive member mounted to said linkage assemblies; and an impeller shroud for encasing a rotatable centrifugal compressor and maintaining a clearance gap between the impeller shroud and the rotatable centrifugal compressor, wherein the impeller shroud is slidably coupled at a forward end to said casing and mounted to said linkage assemblies, said impeller shroud moving relative to the rotatable centrifugal compressor in an axial direction while substantially maintaining a radial alignment when said thermal actuator is actuated.

2. The compressor shroud assembly of claim 1 wherein said linkage assemblies each comprise a forward linkage pivotally mounted to said casing, an aft linkage pivotally mounted to said shroud, and a central linkage pivotally mounted to said forward and aft linkages.

3. The compressor shroud assembly of claim 2 wherein said annular thermal drive member is mounted to said central linkage and is adapted to radially expand or contract responsive to exposure to an actuating temperature, said annular thermal drive member expanding radially to effect movement of said shroud in an axially forward direction, said annular thermal drive member contracting radially to effect movement of said shroud in an axially aft direction.

4. The compressor shroud assembly of claim 3 wherein said annular thermal drive member is exposed to an actuating temperature by exposure to one or more of an actuating air, electrical heating elements, lubricant flow, or fluid flow.

5. The compressor shroud assembly of claim 4 wherein said annular thermal drive member is exposed to air drawn from the core air of the turbine engine.

6. The compressor shroud assembly of claim 2 further comprising an annular thermal drive ring coupled to the central linkage and adapted to axially expand or contract responsive to exposure to an actuating temperature, said annular thermal drive ring contracting axially to effect movement of said shroud in an axially forward direction, said annular thermal drive ring expanding axially to effect movement of said shroud in an axially aft direction.

7. The compressor shroud assembly of claim 6 wherein said annular thermal drive ring is exposed to an actuating temperature by exposure to one or more of an actuating air, electrical heating elements, lubricant flow, or fluid flow.

8. The compressor shroud assembly of claim 7 wherein said annular thermal drive ring is exposed to air drawn from the core air of the turbine engine.

9. The compressor shroud assembly of claim 1 wherein a slidable coupling between said shroud and said casing is dimensioned to maintain an air boundary during the full range of axial movement of said shroud.

10. The compressor shroud assembly of claim 3 further comprising one or more sensors for measuring the temperature in a cavity at least partly defined by said annular thermal drive member, said annular thermal drive member being exposed to warmer or cooler actuating temperatures in response to the measured temperature in said cavity.

11. The compressor shroud assembly of claim 10 further comprising one or more sensors for measuring the clearance gap between said shroud and the rotatable centrifugal compressor, said annular thermal drive member being exposed to warmer or cooler actuating temperatures in response to the clearance gap measure by the one or more sensors.

12. The compressor shroud assembly of claim 6 further comprising one or more sensors for measuring the temperature in a cavity at least partly defined by said annular thermal drive ring, said annular thermal drive ring being exposed to warmer or cooler actuating temperatures in response to the measured temperature in said cavity.

13. A compressor shroud assembly in a turbine engine comprising:

a static compressor casing;

a thermal actuator comprising:

one or more linkage assemblies mounted to said casing and being spaced around the circumference thereof;

a thermal drive member mounted to said linkage assemblies; and an impeller shroud for encasing a rotatable centrifugal compressor and maintaining a clearance gap between the impeller shroud and the rotatable centrifugal compressor, wherein the impeller shroud is mounted at a forward end to said casing and mounted to said linkage assemblies, said impeller shroud moving relative to the rotatable centrifugal compressor in a cantilevered manner from said forward end thereof when said thermal actuator is actuated.

14. The compressor shroud assembly of claim 13 wherein said linkage assemblies each comprise a forward linkage pivotally mounted to said casing, an aft linkage pivotally mounted to said shroud, and a central linkage pivotally mounted to said forward and aft linkages; and wherein said ring is mounted to said central linkage and adapted to radially expand or contract responsive to exposure to an actuating temperature, said ring expanding radially to effect movement of said shroud in an axially forward direction, said ring contracting radially to effect movement of said shroud in an axially aft direction.

15. A method of dynamically changing a clearance gap between a rotatable centrifugal compressor and a shroud encasing the rotatable centrifugal compressor, said method comprising:

mounting a thermal driver comprising a ring and a plurality of linkage assemblies to a static casing;

mounting a shroud to the thermal driver; and actuating the thermal driver to thereby move the shroud relative to a rotatable centrifugal compressor.

16. The method of claim 15 further comprising providing actuating air to actuate the thermal driver.

17. The method of claim 16 wherein said actuating air is one of inducer air, exducer air, intermediate stage compressor air, or discharge air from the centrifugal compressor.

18. The method of claim 15 further comprising slidably coupling the forward end of the shroud to the casing, wherein the shroud moves relative to the rotatable centrifugal compressor in an axial direction while substantially maintaining a radial alignment when the thermal driver is actuated.

19. The method of claim 15 further comprising sensing the fluid temperature in a cavity at least partly defined by said thermal driver and actuating the thermal driver in response to the sensed fluid temperature.

20. The method of claim 15 further comprising sensing the clearance gap between the rotatable centrifugal compressor and the shroud and actuating the thermal driver in response to the sensed clearance gap.

* * * * *